US008371056B1

(12) United States Patent
Baker et al.

(10) Patent No.: US 8,371,056 B1
(45) Date of Patent: Feb. 12, 2013

(54) FIREARM ACCESSORY RAIL ADAPTOR BRACKET

(76) Inventors: Robert Baker, Shreveport, LA (US); Karen Baker, Shreveport, LA (US)

( * ) Notice: Subject to any disclaimer, the term of this patent is extended or adjusted under 35 U.S.C. 154(b) by 350 days.

(21) Appl. No.: 12/799,329

(22) Filed: Apr. 22, 2010

(51) Int. Cl.
*F41A 15/00* (2006.01)

(52) U.S. Cl. ..... 42/90; 42/72; 42/106; 89/37.04

(58) Field of Classification Search ..... 42/90, 72, 42/106, 71.01, 85; 89/37.04, 37.01
See application file for complete search history.

(56) References Cited

U.S. PATENT DOCUMENTS

| | | | | |
|---|---|---|---|---|
| 7,356,958 | B2 * | 4/2008 | Weir | 42/69.01 |
| 2005/0217161 | A1 * | 10/2005 | Haugen et al. | 42/124 |
| 2010/0229450 | A1 * | 9/2010 | Becker et al. | 42/90 |
| 2011/0099877 | A1 * | 5/2011 | Sandler | 42/90 |

* cited by examiner

*Primary Examiner* — J. Woodow Eldred
(74) *Attorney, Agent, or Firm* — R. Keith Harrison

(57) ABSTRACT

A firearm accessory rail adaptor bracket includes a bracket body, a rifle attachment jaw assembly carried by the bracket body, a first jaw operating mechanism provided in the rifle attachment jaw assembly, a pistol attachment jaw assembly carried by the bracket body and a second jaw operating mechanism provided in the pistol attachment jaw assembly.

16 Claims, 7 Drawing Sheets

FIREARM ACCESSORY RAIL ADAPTOR BRACKET

FIELD

The disclosure generally relates to firearms. More particularly, the disclosure relates to a firearm accessory rail adaptor bracket which is suitable for attaching a pistol to an accessory rail on a rifle in a pistol-grip position.

BACKGROUND

Firearms of virtually all types are extensively used by hobbyists and hunters for recreation and by law enforcement and military personnel for protection and enforcement purposes. One type of firearm which is popular among firearm enthusiasts and sometimes used by law enforcement personnel is the semiautomatic rifle, which fires a projectile upon each depression of a trigger. A typical semiautomatic rifle generally includes a stock, a chamber which extends forwardly from the stock and a barrel which extends forwardly from the chamber. A detachable cartridge which contains spring-loaded rounds typically inserts into the chamber and biases each round into the chamber preparatory to firing. A hand grip typically extends from the chamber between the cartridge and the stock.

Many semiautomatic rifles are highly customizable and can be fitted with a variety of accessories depending on the requirements or preferences of the user. In some applications, an accessory rail assembly is fitted on the barrel of the rifle to facilitate attachment of the accessories to the rifle. The accessory rail assembly may include both an upper rail which facilitates attachment of an accessory such as a sighting scope to the upper portion of the barrel and a lower rail which facilitates attachment of an accessory such as a pistol grip to the lower portion of the barrel. The accessory rails typically include standard flanges which insert into like-sized and shaped grooves provided on the accessories that are attached to the rails. Some pistols include an accessory rail which facilitates attachment of accessories to the barrel of the pistol.

A pistol grip provides a front grip in addition to the standard rear hand grip for a user of a rifle. During operation of the rifle, the front hand grip and the rear pistol grip provide a greater degree of control over movement and aiming of the rifle to a user than does the single standard rear hand grip alone. In some applications, it may be desirable or advantageous for a user of a semiautomatic or other rifle to attach a pistol to the rifle at the front pistol grip position in order to provide enhanced control over movement and aiming of the rifle and to facilitate quick removal and use of the pistol as deemed necessary.

Therefore, a firearm rail adaptor bracket which is suitable for attaching a pistol to an accessory rail on a rifle in a front pistol-grip position on the rifle is needed.

SUMMARY

The disclosure is generally directed to a firearm accessory rail adaptor bracket. An illustrative embodiment of the firearm accessory rail adaptor bracket includes a bracket body; a rifle attachment jaw assembly carried by the bracket body; and a pistol attachment jaw assembly carried by the bracket body.

In some embodiments, the firearm accessory rail adaptor bracket may include a bracket body; a rifle attachment jaw assembly carried by the bracket body; a rifle attachment rail slot provided in the rifle attachment jaw assembly; a first jaw operating mechanism provided in the rifle attachment jaw assembly; a pistol attachment jaw assembly carried by the bracket body; a pistol attachment rail slot provided in the pistol attachment jaw assembly; an accessory attachment rail carried by the pistol attachment jaw assembly; and a second jaw operating mechanism provided in the pistol attachment jaw assembly.

In some embodiments, the firearm accessory rail adaptor bracket may include a bracket body including a pair of spaced-apart bracket side plates; a pistol space defined by and between the bracket side plates; a rifle attachment jaw assembly carried by the bracket body and having an interior surface facing the pistol space, an exterior surface opposite the interior surface and a fixed jaw and a movable jaw provided at the exterior surface; a rifle attachment rail slot provided in the fixed jaw and the movable jaw of the rifle attachment jaw assembly; a pistol attachment jaw assembly carried by the bracket body and having an interior surface facing the pistol space, an exterior surface opposite the interior surface and a fixed jaw and a movable jaw provided at the exterior surface; and a pistol attachment rail slot provided in the pistol attachment jaw assembly; a first jaw operating mechanism provided in the rifle attachment jaw assembly; and a second jaw operating mechanism provided in the pistol attachment jaw assembly.

BRIEF DESCRIPTION OF THE DRAWINGS

The disclosure will now be made, by way of example, with reference to the accompanying drawings, in which.

DETAILED DESCRIPTION

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Figure 7:
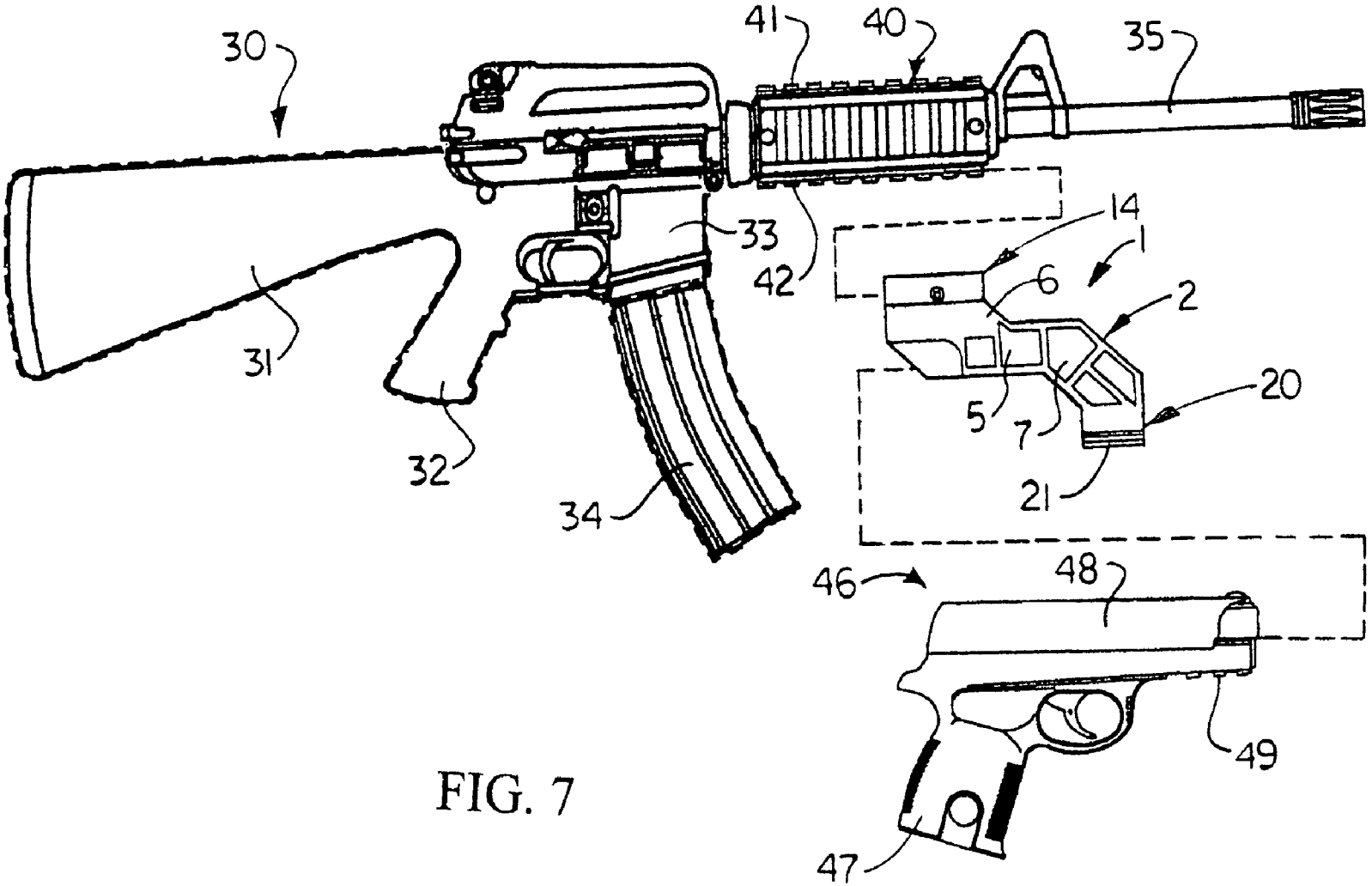
FIG. 7 is an exploded side view which illustrates exemplary attachment of the firearm accessory rail adaptor bracket to an accessory rail assembly on a rifle and attachment of a pistol to the firearm rail adaptor bracket.
Figure 8:
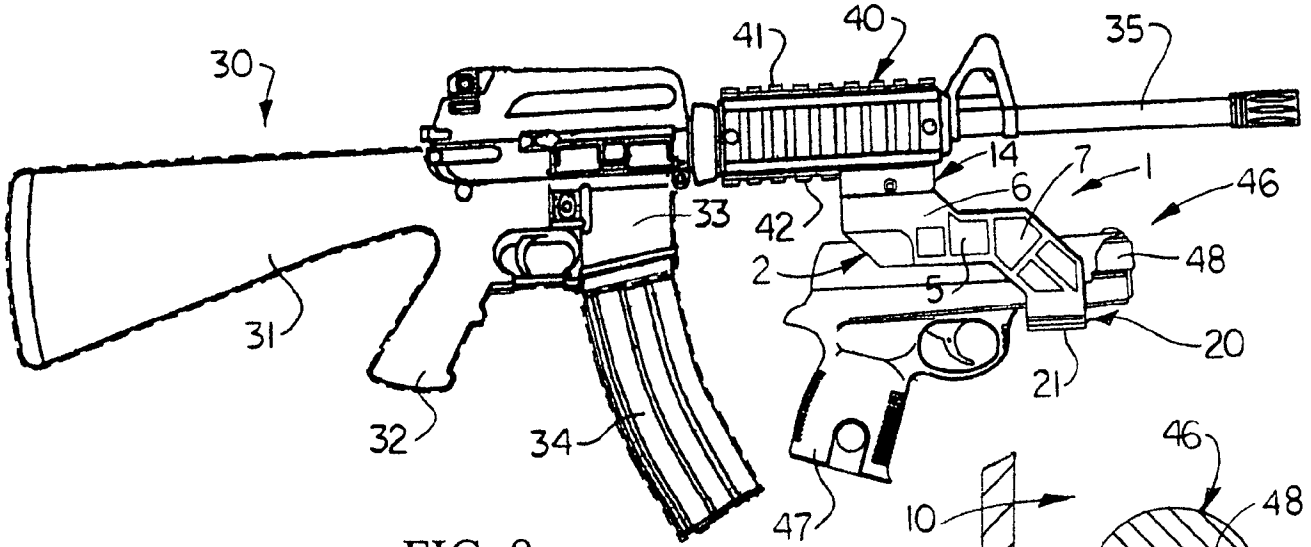
FIG. 8 is a side view of a rifle with the firearm accessory rail adaptor bracket attached to the rifle and a pistol attached to the firearm rail adaptor bracket.
Figure 10:
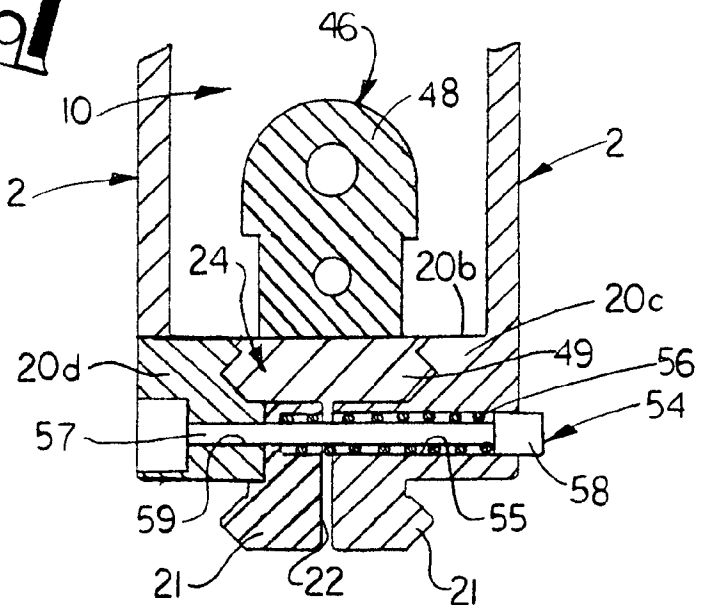
FIG. 10 is a sectional view illustrating flanged attachment of the pistol to the firearm accessory rail adaptor bracket.

Referring initially to FIGS. 7 and 8 of the drawings, an illustrative embodiment of the firearm accessory rail adaptor bracket, hereinafter bracket, is generally indicated by reference numeral 1. As will be hereinafter described, the bracket 1 is suitable for attaching a pistol 46 to a rifle 30 in a front pistol-grip position on the rifle 30. The bracket 1 may be metal such as steel or aluminum or a non-metallic material such as a carbon fiber composite material, for example and without limitation. The bracket 1 may be fabricated using conventional casting, molding, welding, machining and/or other manufacturing techniques known by those skilled in the art. The bracket 1 may be adapted for attachment to a bottom rail 42 of an accessory rail assembly 40 which is provided on the rifle 30. In some applications the accessory rail assembly 40 may be a conventional Weaver rail mount or Picatinny mount (such as a mil-standard 1913 rail), for example and without limitation. The bracket 1 may also be adapted for fixed or removable attachment to a pistol rail 49 (FIG. 7) which is provided on the pistol 46 to facilitate attachment of the pistol 46 to the bracket 1.

The bracket 1 may include a bracket body 8 having a pair of spaced-apart bracket side plates 2. Each bracket side plate 2 may include a generally straight center portion 5. A first angled portion 6 and a second angled portion 7 may extend from opposite ends of the center portion 5. A rifle attachment portion 3 and a pistol attachment portion 4 may extend from the first angled portion 6 and the second angled portion 7, respectively. In some embodiments, the first angled portion 6 and the second angled portion 7 may each be oriented at a generally 45-degree angle with respect to the center portion 5. The rifle attachment portion 3 may be oriented at a generally 45-degree angle with respect to the first angled portion 6. The pistol attachment portion 4 may be oriented at a generally 45-degree angle with respect to the second angled portion 7.

A rifle attachment jaw assembly 14 may extend between the rifle attachment portions 3 of the bracket side plates 2. A pistol attachment jaw assembly 20 may extend between the pistol attachment portions 4 of the bracket side plates 2. A pistol space 10 may be defined by and between the bracket side plates 2, the rifle attachment jaw assembly 14 and the pistol attachment jaw assembly 20. The rifle attachment jaw assembly 14 may have an exterior surface 14*a* and an interior surface 14*b* which is opposite the exterior surface 14*a* and faces the pistol space 10. The pistol attachment jaw assembly 20 may have an exterior surface 20*a* and an interior surface 20*b* which is opposite the exterior surface 20*a* and faces the pistol space 20.

The rifle attachment jaw assembly 14 may include a fixed jaw 14*c* and a movable jaw 14*d*. A rifle attachment rail slot 15 may be provided in the exterior surface 14*a* of the fixed jaw 14*c* and the movable jaw 14*d* of the rifle attachment jaw assembly 14. The rifle attachment rail slot 15 may have any cross-sectional shape which is complementary to the bottom rail 42 of the accessory rail assembly 40. In some embodiments, the rifle attachment rail slot 15 may include a flat slot portion 16 which is recessed in the exterior surface 14*a* of the rifle attachment frame 14 and a pair of spaced-apart slot grooves 17 which extend along respective sides of the flat slot portion 16.

The pistol attachment jaw assembly 20 may include a fixed jaw 20*c* and a movable jaw 20*d*. A pistol attachment rail slot 24 may be provided in the interior surface 20*b* of the fixed jaw 20*c* and the movable jaw 20*d* of the pistol attachment jaw assembly 20. The pistol attachment rail slot 24 may have any cross-sectional shape which is complementary to the pistol rail 49 (FIG. 7) provided on the pistol 46. In some embodiments, the pistol attachment rail slot 24 may include a flat slot portion 25 which is recessed in the interior surface 20*b* of the pistol attachment jaw assembly 20 and a pair of spaced-apart slot grooves 26 which extend along respective sides of the flat spot portion 25. An accessory attachment rail 21 may be provided on the exterior surface 20*a* of the fixed jaw 20*c* of the pistol attachment jaw assembly 20 for purposes which will be hereinafter described. The accessory attachment rail 21 may have the same size and configuration as the pistol rail 49 (FIG. 7) on the pistol 46. In some embodiments, a rail slot 22 may extend through the accessory attachment rail 21.

Figure 2:
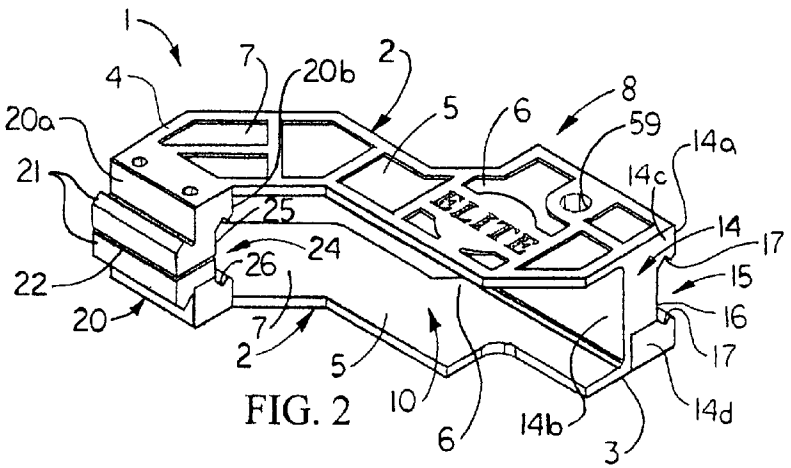
FIG. 2 is a bottom perspective view of an illustrative embodiment of the firearm accessory rail adaptor bracket.
Figure 1:
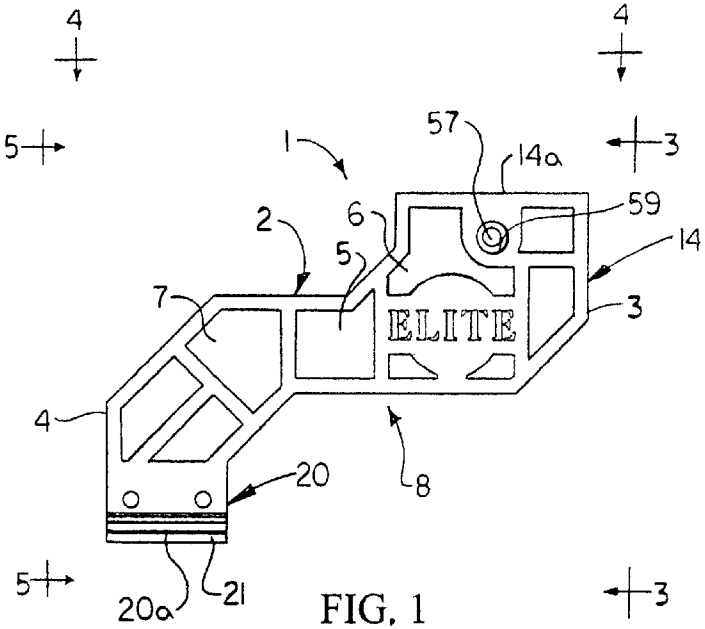
FIG. 1 is a left side view of an illustrative embodiment of the firearm accessory rail adaptor bracket.
Figure 3:
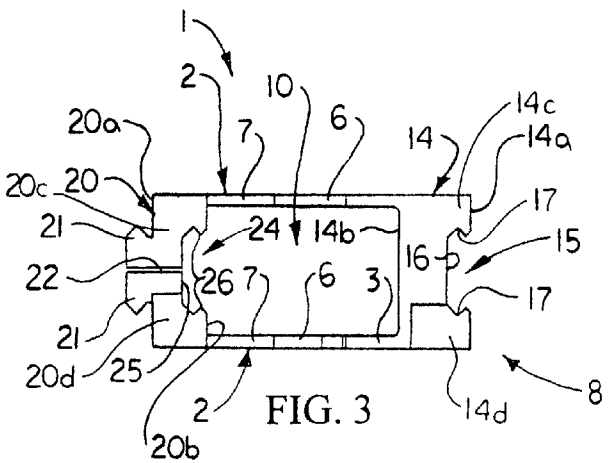
FIG. 3 is a front view, taken along viewing lines 3-3 in FIG. 1, of an illustrative embodiment of the firearm accessory rail adaptor bracket.
Figure 3B:
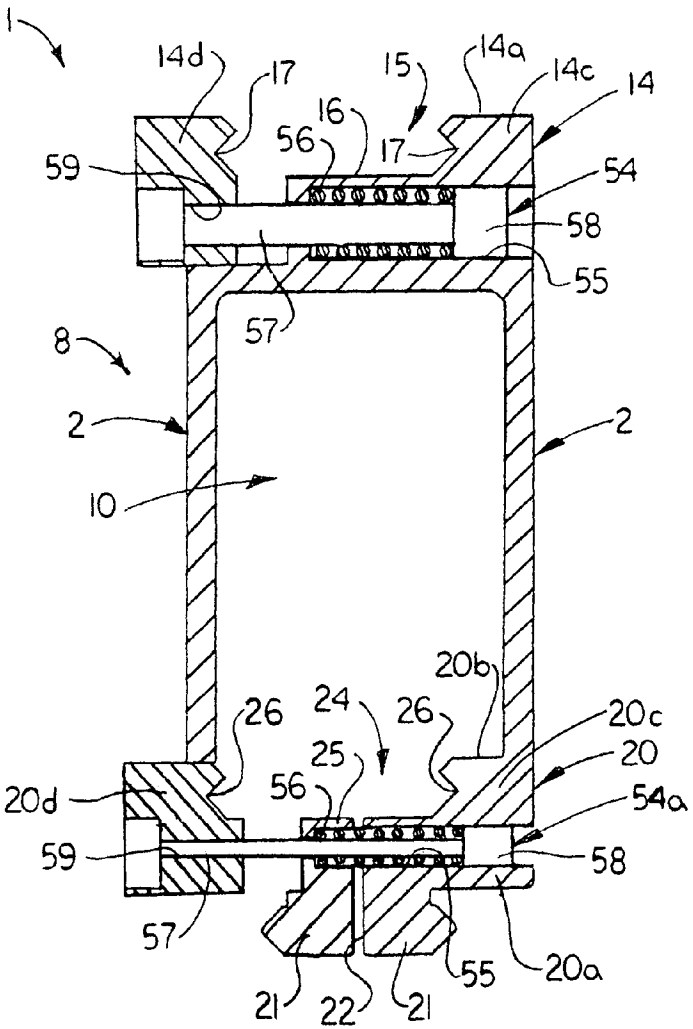
FIG. 3B is a cross-sectional view of an illustrative embodiment of the firearm accessory rail adaptor bracket, with the rifle attachment jaw assembly and the pistol attachment jaw assembly illustrated in a closed position.
Figure 3A:
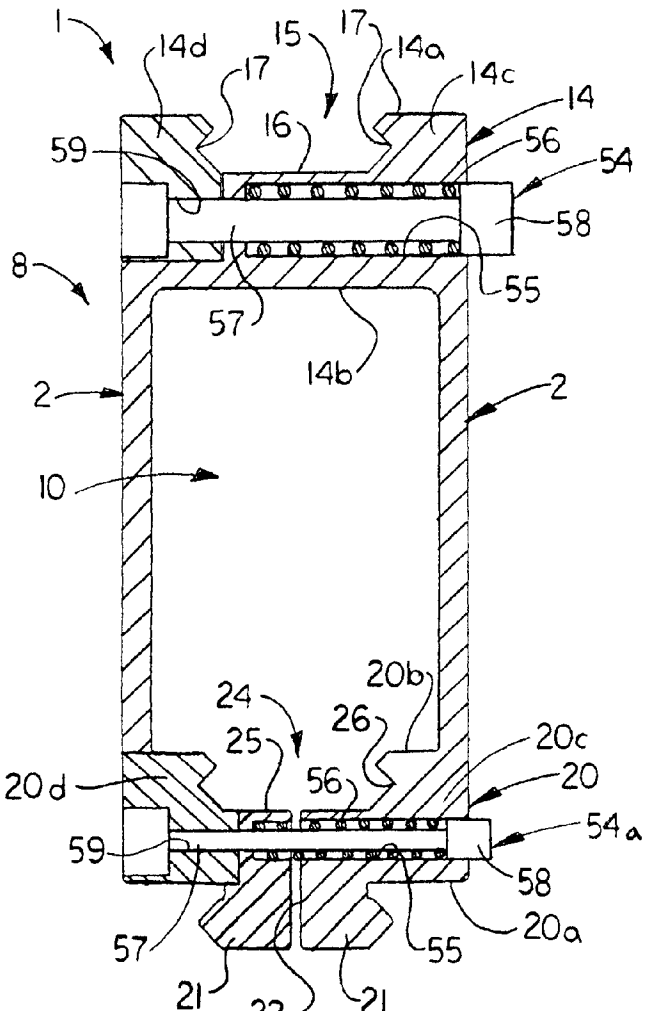
FIG. 3A is a cross-sectional view of an illustrative embodiment of the firearm accessory rail adaptor bracket, with the rifle attachment jaw assembly and the pistol attachment jaw assembly illustrated in an open position.
Figure 5:
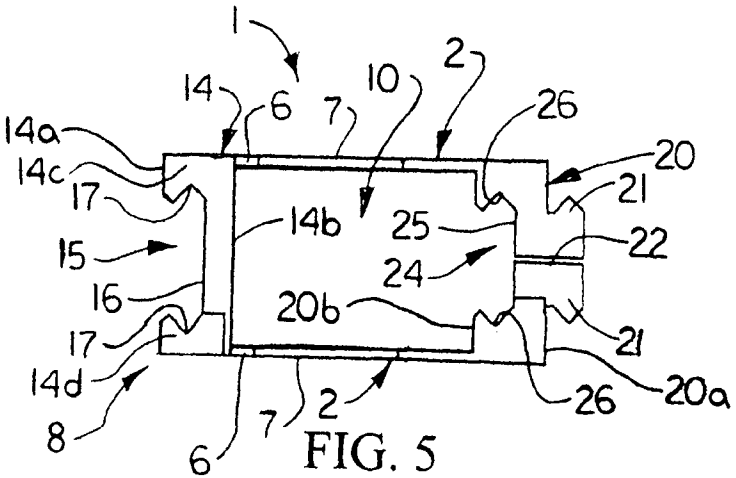
FIG. 5 is a rear view, taken along viewing lines 5-5 in FIG. 1, of an illustrative embodiment of the firearm accessory rail adaptor bracket.
Figure 4:
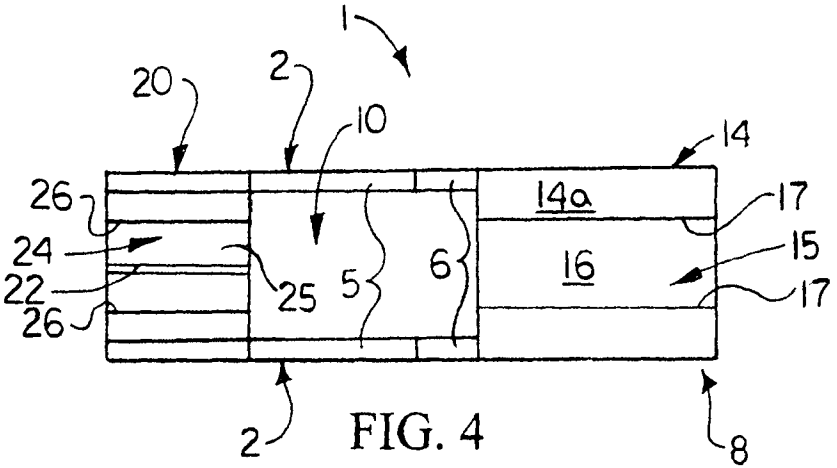
FIG. 4 is a top view, taken along viewing lines 4-4 in FIG. 1, of an illustrative embodiment of the firearm accessory rail adaptor bracket.
Figure 6:
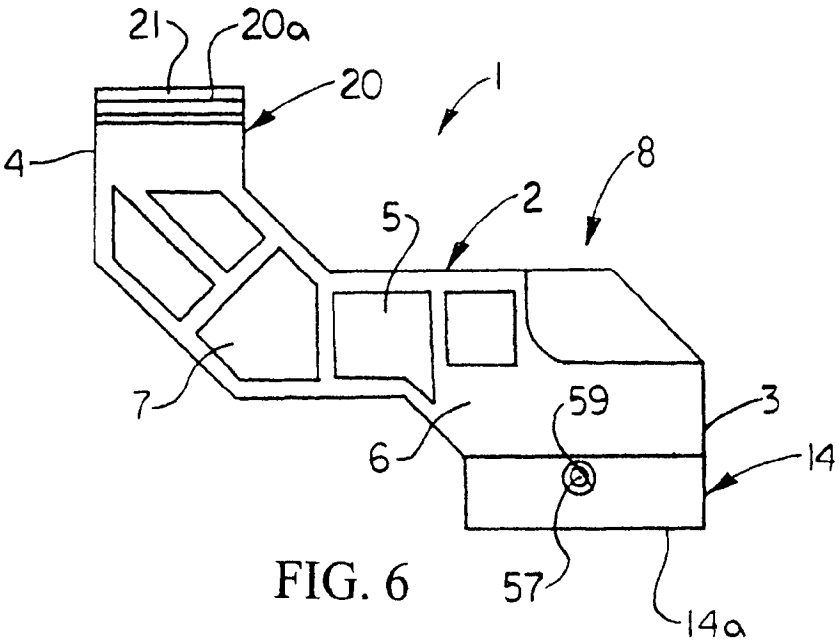
FIG. 6 is a right side view of an illustrative embodiment of the firearm accessory rail adaptor bracket.

As illustrated in FIGS. 3A and 3B, in some embodiments, a jaw operating mechanism 54 may be provided in the rifle attachment jaw assembly 14 to facilitate selective opening and closing of the movable jaw 14*d* with respect to the fixed jaw 14*c*. In other embodiments, the fixed jaw 14*c* and the movable jaw 14*d* may both be fixed to facilitate fixed attachment of the bracket 1 to the accessory rail assembly 40 on the rifle 30. In some embodiments, the jaw operating mechanism 54 may include a transversely-extending spring cavity 55 which is provided in the fixed jaw 14*c*. A rod opening 59 may communicate with the spring cavity 55 and extend through the fixed jaw 14*c* and the movable jaw 14*d*. A jaw actuating rod 57 may extend from the spring cavity 55 and through the rod opening 59 into the movable jaw 14*d* where the jaw actuating rod 57 is attached to the movable jaw 14*d* using a threaded or other connection (not illustrated). A jaw actuating button 58 may be provided on the jaw actuating rod 57 and slidably disposed in the spring cavity 55. A coiled spring 56 may be provided in the spring cavity 55 and interposed between the jaw actuating button 58 and the end wall (not labeled) of the spring cavity 55. Accordingly, as illustrated in FIG. 3A, the spring 56 normally biases the jaw actuating button 58 from the spring cavity 55 such that the jaw actuating rod 57 maintains the movable jaw 14*d* in a closed position against the fixed jaw 14*c*. Upon depression of the jaw actuating button 58 into the spring cavity 55, as illustrated in FIG. 3B, the jaw actuating button 58 slides in the spring cavity 55 and the spring 56 is compressed between the jaw actuating button 58 and the end wall of the spring cavity 55 while the jaw actuating rod 57 pushes the movable jaw 14*d* away from the fixed jaw 14*c*. Release of the jaw actuating button 58 causes the spring 56 to expand and return the jaw actuating rod 57 and the movable jaw 14*d* back to the closed position against the fixed jaw 14*c* as illustrated in FIG. 3A. In some embodiments, a jaw operating mechanism 54*a* of like design may be provided in the pistol attachment jaw assembly 20 to facilitate selective opening and closing of the movable jaw 20*d* with respect to the fixed jaw 20*c* in a like manner. In other embodiments, the fixed jaw 20*c* and the movable jaw 20*d* may both be fixed to facilitate fixed attachment of the bracket 1 to the pistol rail 49 on the pistol 46. The jaw operating mechanism 54, 54*a* of the rifle attachment jaw assembly 14 and the pistol attachment jaw assembly 20, respectively, may have alternative designs known by those skilled in the art to facilitate selective movement of the movable jaw 14*c*, 20*c* with respect to the fixed jaw 14*d*, 20*d*, respectively. In some embodiments, a lever (not illustrated) or other structure may be used instead of the jaw actuating button 58 to actuate the movable jaw 14*d* of the rifle attachment jaw assembly 14.

Referring next to FIGS. 7-12 of the drawings, in typical application the bracket 1 is used to attach a pistol 46 to a rifle 30 at a front pistol-grip position on the rifle 30. The pistol 46 may have a conventional design with a pistol grip 47, a pistol barrel 48 extending forwardly from the pistol grip 47 and a pistol rail 49 provided on the underside of the pistol barrel 48. In some applications, the rifle 30 may be a semi-automatic rifle having a conventional design with a stock 31 and rear grip 32, with a chamber 33 in front of the rear grip 32 and a barrel 35 extending forwardly from the chamber 33. A detachable cartridge 34 which contains a supply of spring-loaded rounds (not illustrated) may interface with the chamber 33 to individually and sequentially bias the rounds into the chamber 33 as the rifle 30 is fired, as is known by those skilled in the art.

An accessory rail assembly 40, which may be conventional, is provided on the barrel 35 of the rifle 30. The accessory rail assembly 40 includes a bottom rail 42 which in conventional usage facilitates attachment of an accessory such as a pistol grip (not illustrated) to the barrel 35. In some applications, the accessory rail assembly 40 may also include a top rail 41 which in conventional usage facilitates attachment of an accessory such as a sighting scope (not illustrated) to the barrel 35.

Figure 9:
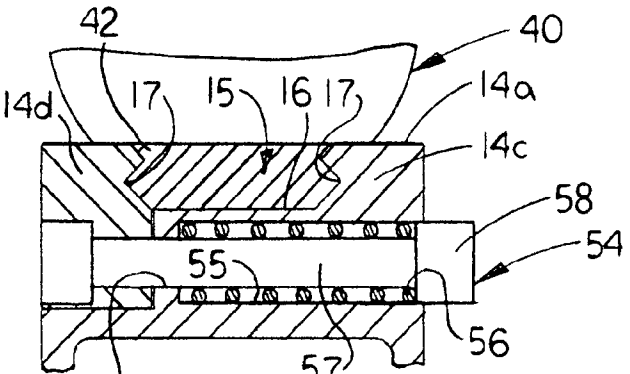
FIG. 9 is a sectional view illustrating flanged attachment of the firearm accessory rail adaptor bracket to the accessory rail assembly on the rifle.

The bracket 1 is attached to the bottom rail 42 of the accessory rail assembly 40 typically as follows. The movable jaw 14*d* is opened with respect to the fixed jaw 14*c* of the rifle attachment jaw assembly 14 by depression of the jaw actuating button 58 of the jaw operating mechanism 54, as was heretofore described with respect to FIG. 3B. Simultaneously, the bottom rail 42 of the accessory rail assembly 40 on the rifle 30 is inserted into the rifle attachment rail slot 15. The jaw actuating button 58 of the jaw operating mechanism 54 is then released to return the movable jaw 14*d* to the closed position illustrated in FIG. 3A and lock the bottom rail 42 in the rifle attachment rail slot 15, as illustrated in FIG. 9. In some embodiments, the bracket 1 may be fixedly attached to the accessory rail assembly 40 and/or other structural element or elements of the rifle 30. The bracket 1 may be attached to the bottom rail 42 of the of the accessory rail assembly 40 such as by replacing the spring 56, the jaw actuating rod 57 and the jaw actuating button 58 (FIGS. 3A and 3B) with a bolt or other fastener (not illustrated) which extends through the rod opening 59 and the spring cavity 55 and secures the movable jaw 14*d* and the fixed jaw 14*c* on respective sides of the bottom rail 42. The bracket 1 may be fixedly attached to the accessory rail assembly 40 using other suitable attachment techniques known by those skilled in the art including but not limited to welding and molding.

The pistol rail 49 on the pistol 46 is attached to the pistol attachment rail slot 24 provided in the pistol attachment jaw assembly 20 by inserting the pistol barrel 48 of the pistol 46 through the pistol space 10, opening the movable jaw 20*c* with respect to the fixed jaw 20*d* by operation of the jaw operating mechanism 54*a*, inserting the pistol rail 49 on the pistol 46 into the pistol attachment rail slot 24 and closing the movable jaw 20*c* against the fixed jaw 20*d* by releasing the jaw operating mechanism 54*a*. Accordingly, the pistol 46 is locked in place in the pistol space 10 of the bracket 1, as illustrated in FIG. 8. A user (not illustrated) of the rifle 30 can grip the rear grip 32 with one hand and the pistol grip 47 of the pistol 46 with the other hand to enhance accuracy in moving and aiming the rifle 30 during shooting of the rifle 30. As illustrated in FIG. 8, when the pistol 46 is mounted on the bracket 1, the accessory attachment rail 21 on the bracket 1 may remain exposed to facilitate attachment of an accessory (not illustrated) such as a lamp, for example and without limitation, to the accessory attachment rail 21.

Figure 11:
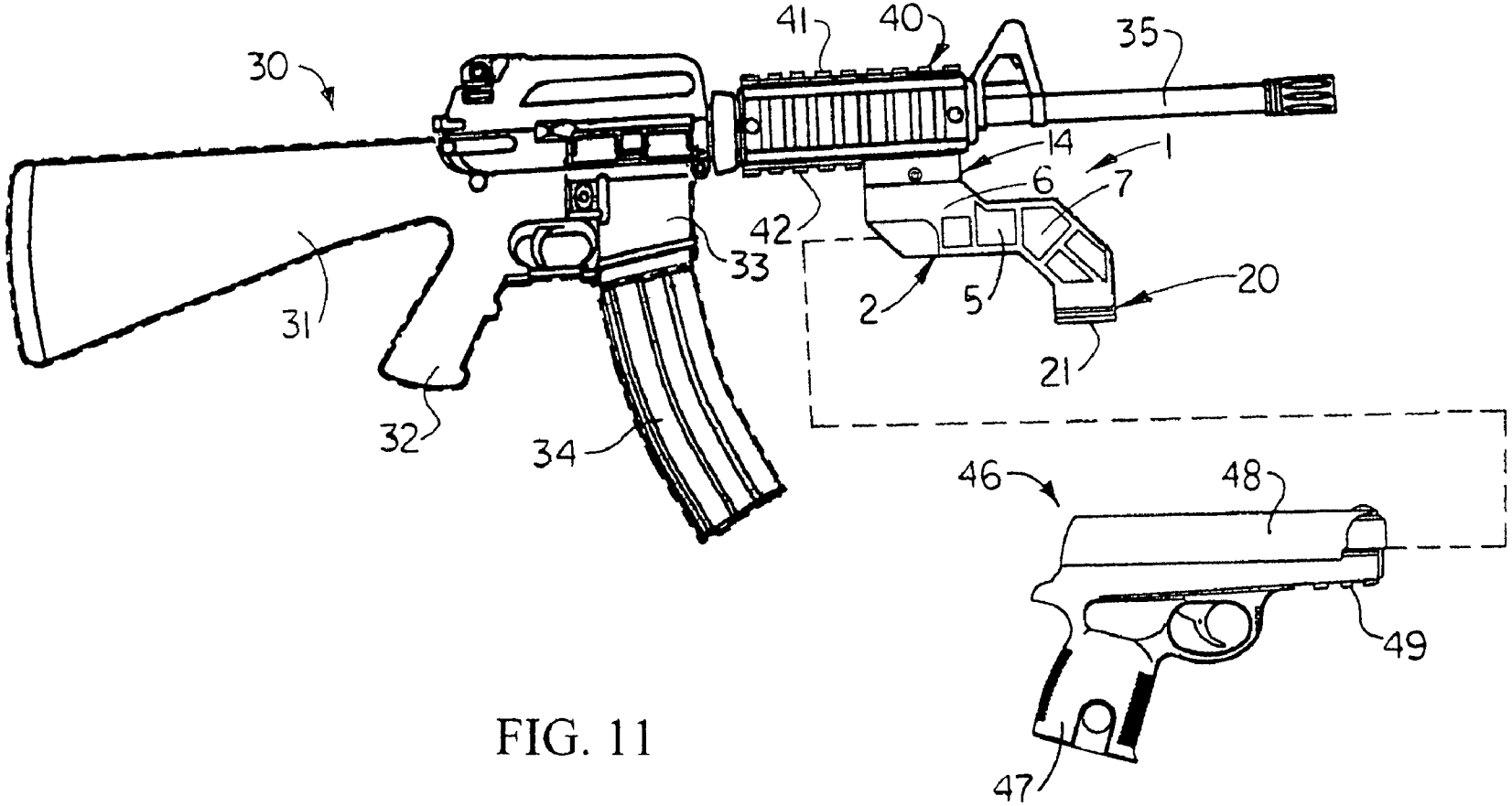
FIG. 11 is an exploded side view which illustrates the pistol detached from the firearm accessory rail adaptor bracket as the bracket remains attached to the firearm.
Figure 12:
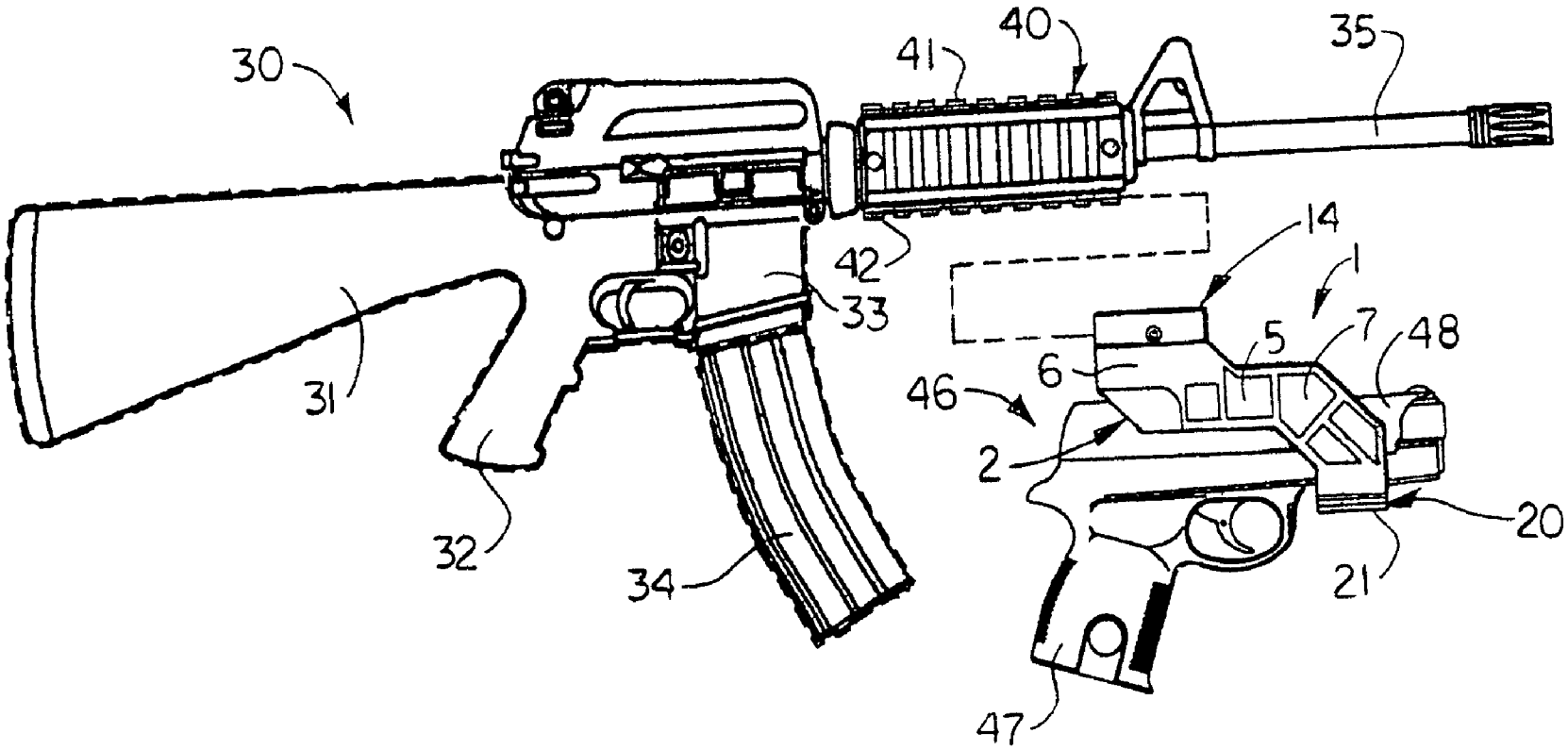
FIG. 12 is an exploded side view which illustrates the pistol and the firearm accessory rail adaptor bracket from the rifle as the pistol remains attached to the bracket.

As illustrated in FIG. 11, in some applications the pistol 46 can be selectively removed from the bracket 1 while the bracket 1 remains attached to the rifle 30, enabling the user to shoot the pistol 46 apart from the rifle 30. As illustrated in FIG. 12, in some applications the pistol 46 can remain attached to the bracket 1 as the bracket 1 is detached from the rifle 30 under circumstances in which use of the rifle 30 without the bracket 1 and the pistol 46 attached thereto is desired.

While the preferred embodiments of the disclosure have been described above, it will be recognized and understood that various modifications can be made in the disclosure and the appended claims are intended to cover all such modifications which may fall within the spirit and scope of the disclosure.

What is claimed is:

1. A firearm accessory rail adaptor bracket for attaching a pistol to a rifle comprising:

a bracket body including a pair of spaced-apart bracket side plates each having a generally straight center portion; first and second angled portions extending at a generally 45-degree angle from said center portion; and a rifle attachment portion and a pistol attachment portion extending at a generally 45-degree angle from said first angled portion and said second angled portion, respectively;

a rifle attachment jaw assembly carried by said rifle attachment portion of said bracket side plates of said bracket body and adapted to detachably grip the rifle; and a pistol attachment jaw assembly carried by said pistol attachment portion of said bracket side plates of said bracket body and adapted to detachably grip the pistol.

2. The firearm accessory rail adaptor bracket of claim 1 further comprising a first jaw operating mechanism provided in said rifle attachment jaw assembly and a second jaw operating mechanism provided in said pistol attachment jaw assembly.

3. The firearm accessory rail adaptor bracket of claim 1 further comprising a pistol space between said bracket side plates, said pistol space sized and configured to accommodate the pistol.

4. The firearm accessory rail adaptor bracket of claim 1 wherein said rifle attachment jaw assembly comprises a fixed jaw and a movable jaw adjacent to said fixed jaw.

5. The firearm accessory rail adaptor bracket of claim 4 further comprising a rifle attachment rail slot provided in said movable jaw and said fixed jaw.

6. The firearm accessory rail adaptor bracket of claim 1 wherein said pistol attachment jaw assembly comprises a fixed jaw and a movable jaw adjacent to said fixed jaw.

7. firearm accessory rail adaptor bracket of claim 6 further comprising a pistol attachment rail slot provided in said movable jaw and said fixed jaw.

8. A firearm accessory rail adaptor bracket for attaching a pistol to a rifle, comprising:

a bracket body including a pair of spaced-apart bracket side plates each having a generally straight center portion; first and second angled portions extending at a generally 45-degree angle from said center portion; and a rifle attachment portion and a pistol attachment portion extending at a generally 45-degree angle from said first angled portion and said second angled portion, respectively;

a rifle attachment jaw assembly carried by said rifle attachment portion of said bracket side plates of said bracket body and adapted to detachably grip the rifle;

a rifle attachment rail slot provided in said rifle attachment jaw assembly;

a first jaw operating mechanism provided in said rifle attachment jaw assembly;

a pistol attachment jaw assembly carried by said pistol attachment portion of said bracket side plates of said bracket body and adapted to detachably grip the pistol;

a pistol attachment rail slot provided in said pistol attachment jaw assembly;

an accessory attachment rail carried by said pistol attachment jaw assembly; and a second jaw operating mechanism provided in said pistol attachment jaw assembly.

9. The firearm accessory rail adaptor bracket of claim 8 further comprising a pistol space between said bracket side plates, said pistol space sized and configured to accommodate the pistol.

10. The firearm accessory rail adaptor bracket of claim 8 wherein said rifle attachment jaw assembly comprises a fixed jaw and a movable jaw adjacent to said fixed jaw.

11. The firearm accessory rail adaptor bracket of claim 10 wherein said rifle attachment rail slot is provided in said movable jaw and said fixed jaw.

12. The firearm accessory rail adaptor bracket of claim 8 wherein said pistol attachment jaw assembly comprises a fixed jaw and a movable jaw adjacent to said fixed jaw.

13. The firearm accessory rail adaptor bracket of claim 12 wherein said pistol attachment rail slot is provided in said movable jaw and said fixed jaw.

14. A firearm accessory rail adaptor bracket for attaching a pistol to a rifle, comprising:

a bracket body including:

a pair of spaced-apart bracket side plates each having a generally straight center portion; first and second angled portions extending at a generally 45-degree angle from said center portion; and a rifle attachment portion and a pistol attachment portion extending at a generally 45-degree angle from said first angled portion and said second angled portion, respectively;

a pistol space defined by and between said bracket side plates, said pistol space sized and configured to accommodate the pistol;

a rifle attachment jaw assembly carried by said rifle attachment portion of said bracket side plates of said bracket body and adapted to detachably grip the rifle, the rifle attachment jaw assembly having an interior surface facing said pistol space, an exterior surface opposite said interior surface and a fixed jaw and a movable jaw provided at said exterior surface;

a rifle attachment rail slot provided in said fixed jaw and said movable jaw of said rifle attachment jaw assembly;

a pistol attachment jaw assembly carried by said pistol attachment portion of said bracket side plates of said bracket body and adapted to detachably grip the pistol, the pistol attachment law assembly having an interior surface facing said pistol space, an exterior surface opposite said interior surface and a fixed jaw and a movable jaw provided at said exterior surface; and a pistol attachment rail slot provided in said pistol attachment jaw assembly;

a first jaw operating mechanism provided in said rifle attachment jaw assembly; and a second jaw operating mechanism provided in said pistol attachment jaw assembly.

15. The firearm accessory rail adaptor bracket of claim 14 further comprising an accessory attachment rail carried by said exterior surface of said pistol attachment jaw assembly.

16. The firearm accessory rail adaptor bracket of claim 14 wherein said first jaw operating mechanism comprises a spring cavity provided in said fixed jaw of said rifle attachment jaw assembly, a jaw actuating rod slidably disposed in said spring cavity and engaging said movable jaw of said rifle attachment jaw assembly and a spring provided in said spring cavity and biasing said jaw actuating rod and said movable jaw of said rifle attachment jaw assembly in a closed position.

* * * * *